US009595761B2

(12) United States Patent
Kato et al.

(10) Patent No.: US 9,595,761 B2
(45) Date of Patent: Mar. 14, 2017

(54) ANTENNA

(75) Inventors: Noboru Kato, Kyoto-fu (JP); Jun Sasaki, Kyoto-fu (JP); Teppei Miura, Kyoto-fu (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 898 days.

(21) Appl. No.: 13/344,243

(22) Filed: Jan. 5, 2012

(65) Prior Publication Data

US 2012/0105302 A1 May 3, 2012

Related U.S. Application Data

(63) Continuation of application No. PCT/JP2010/059113, filed on May 28, 2010.

(30) Foreign Application Priority Data

Jul. 9, 2009 (JP) ..... 2009-162740

(51) Int. Cl.
*H01Q 9/04* (2006.01)
*H01Q 13/08* (2006.01)
*H01Q 13/10* (2006.01)

(52) U.S. Cl.
CPC ..... *H01Q 9/0421* (2013.01); *H01Q 13/08* (2013.01); *H01Q 13/10* (2013.01)

(58) Field of Classification Search
CPC ..... H01Q 9/0421
USPC ..... 343/700 MS
See application file for complete search history.

(56) References Cited

U.S. PATENT DOCUMENTS

| | | | | |
|---|---|---|---|---|
| 5,760,746 | A | 6/1998 | Kawahata | |
| 7,170,448 | B2 | 1/2007 | Jecko et al. | |
| 7,890,053 | B2 | 2/2011 | Washiro | |
| 2007/0080865 | A1* | 4/2007 | Huang et al. | 343/700 MS |
| 2008/0055164 | A1* | 3/2008 | Zhang et al. | 343/702 |
| 2008/0064331 | A1 | 3/2008 | Washiro | |

FOREIGN PATENT DOCUMENTS

| | | | |
|---|---|---|---|
| CN | 101106215 | A | 1/2008 |
| JP | 09-098015 | | 4/1997 |
| JP | 11-145722 | | 5/1999 |
| JP | H11-155722 | A | 6/1999 |

(Continued)

OTHER PUBLICATIONS

International Search Report; PCT/JP2010/059113; Sep. 7, 2010.

(Continued)

*Primary Examiner* — Robert Karacsony
(74) *Attorney, Agent, or Firm* — Studebaker & Brackett PC

(57) ABSTRACT

This disclosure provides an antenna having a high degree of design flexibility. In a representative embodiment, the antenna includes a ground conductor to which a ground potential is applied, a linear conductor that transmits a high-frequency signal, an insulating layer configured to isolate the ground conductor and the linear conductor from each other, and a radiation conductor that is connected between the linear conductor and the ground conductor. The radiation conductor has a line width larger than that of the linear conductor between a point of connection to the linear conductor and a point of connection to the ground conductor, and is configured to emit an electric field.

20 Claims, 13 Drawing Sheets

(56) References Cited

FOREIGN PATENT DOCUMENTS

| | | | |
|---|---|---|---|
| JP | 2008-029037 | A | 2/2008 |
| JP | 2008-099234 | A | 4/2008 |

OTHER PUBLICATIONS

Written Opinion of the International Searching Authority; PCT/JP2010/059113; Sep. 7, 2010.

The First Office Action issued by the State Intellectual Property Office of People's Republic of China on Sep. 3, 2013, which corresponds to Chinese Patent Application No. 201080030321.6 and is related to U.S. Appl. No. 13/344,243; with translation.

* cited by examiner

ANTENNA

CROSS REFERENCE TO RELATED APPLICATIONS

The present application is a continuation of International Application No. PCT/JP2010/059113 filed May 28, 2010, which claims priority to Japanese Patent Application No. 2009-162740 filed Jul. 9, 2009, the entire contents of each of these applications being incorporated herein by reference in their entirety.

TECHNICAL FIELD

The present invention relates to antennas, and, more particularly, to an antenna used for radio communication performed with a high-frequency signal in a UHF or SHF band.

BACKGROUND

As an antenna in the related art, Japanese Unexamined Patent Application Publication No. 2008-99234 (Patent Literature 1) discloses an example of a known antenna used in a communication system disclosed. The antenna disclosed in Patent Literature 1 will now be described below with reference to the accompanying FIGS. 17 to 19. FIG. 17 is a block diagram of a communication system 500 disclosed in Patent Literature 1. FIG. 18 is a perspective view of antennas 520 and 550 used in the communication system 500 illustrated in FIG. 17. FIG. 19 is an equivalent circuit diagram of the antenna 520 illustrated in FIG. 18.

The communication system 500 disclosed in Patent Literature 1 is a system capable of achieving large-capacity transmission by transmitting a high-frequency signal through electric field coupling. More specifically, high-volume data communication can be performed using weak radio waves by applying a communication method, such as a UWB (ultra wide band) communication method, using high frequencies and a wide frequency band to electric field coupling. As illustrated in FIG. 17, the communication system 500 includes a transmission-side electronic apparatus 501 and a receiving-side electronic apparatus 511.

The electronic apparatus 501 includes a transmission circuit unit 502, a resonating unit 504, and a transmission electrode 506. The transmission circuit unit 502 is a circuit for generating a high-frequency signal such as a UWB signal. The transmission electrode 506 emits the high-frequency signal generated by the transmission circuit unit 502 as a radio wave. The resonating unit 504 performs impedance matching between the transmission circuit unit 502 and the transmission electrode 506.

On the other hand, the electronic apparatus 511 includes a receiving circuit unit 512, a resonating unit 514, and a receiving electrode 516. The receiving electrode 516 is coupled to the transmission electrode 506 by electric field coupling and receives the radio wave emitted from the transmission electrode 506. The receiving circuit unit 512 performs demodulation and decoding on the radio wave received by the receiving electrode 516. The resonating unit 514 is a circuit for performing impedance matching between the receiving circuit unit 512 and the receiving electrode 516.

The transmission electrode 506 will be described in detail. As illustrated in FIG. 18, the transmission electrode 506 is a part of the antenna 520. Referring to FIG. 17, the antenna 520 is not illustrated and only the transmission electrode 506 is illustrated. As illustrated in FIG. 18, the antenna 520 includes the transmission electrode 506, a substrate 522, a ground electrode 524, a stub 526, a substrate 528, and via-hole conductors 530 and 532.

The substrate 522 is made of an insulating material. The ground electrode 524 is disposed on the entire undersurface of the substrate 522, and a ground potential is applied to the ground electrode 524. The stub 526 is a linear electrode disposed on the surface of the substrate 522, and has a length approximately half ($\lambda/2$) of the wavelength of a high-frequency signal transmitted and received in the communication system 500. The substrate 528 is made of an insulating material, and is disposed on the surface of the substrate 522 so that it partly covers the stub 526. The transmission electrode 506 is a rectangular electrode disposed on the surface of the substrate 528. The via-hole conductor 530 connects the transmission electrode 506 and the stub 526. The via-hole conductor 532 connects the stub 526 and the ground electrode 524. As illustrated in FIG. 19, the via-hole conductor 530 is connected to the stub 526 at a position apart from the via-hole conductor 532 by a quarter ($\lambda/4$) of the wavelength of a high-frequency signal transmitted and received in the communication system.

On the other hand, like the transmission electrode 506, the receiving electrode 516 is a part of the antenna 550 illustrated in FIG. 18. As illustrated in FIG. 18, the antenna 550 includes the receiving electrode 516, a substrate 552, a ground electrode 554, a stub 556, a substrate 558, and via-hole conductors 560 and 562. The structure of the antenna 550 is the same as that of the antenna 520, and description thereof can be inferred from the description of antenna 520 provided above.

In the antennas 520 and 550 having the above-described structure, the transmission electrode 506 and the receiving electrode 516 are close to each other so that a predetermined distance (for example, 3 cm) is set between the transmission electrode 506 and the receiving electrode 516. More specifically, the antenna 520 is designed so that a predetermined capacitance is generated between the transmission electrode 506 and the receiving electrode 516 and the input impedance of the antenna 520 and the output impedance (for example 50Ω) of the transmission circuit unit 502 match (that is, impedance matching) when the distance between the transmission electrode 506 and the receiving electrode 516 becomes a predetermined distance. Similarly, the antenna 550 is designed so that a predetermined capacitance is generated between the transmission electrode 506 and the receiving electrode 516 and the output impedance of the antenna 550 and the input impedance of the receiving circuit unit 512 match (that is, impedance matching) when the distance between the transmission electrode 506 and the receiving electrode 516 becomes a predetermined distance. As a result, the reflectivity of a high-frequency signal output from the transmission circuit unit 502 becomes low, and the high-frequency signal is input into the antenna 520. Since the stub 526 has a length approximately half of the wavelength of the high-frequency signal, a standing wave is generated at the stub 526 as illustrated in FIG. 19. A similar phenomenon occurs in the antenna 550 and the receiving circuit unit 512, and the description thereof can be inferred from the above description.

As described previously, the via-hole conductor 530 is connected to the stub 526 at the position apart from the via-hole conductor 532 by a quarter ($\lambda/4$) of the wavelength of a high-frequency signal. As illustrated in FIG. 19, this position corresponds to an antinode of a standing wave. That is, the via-hole conductor 530 is connected to the stub 526 at a position at which the largest potential change is obtained. As a result, the change in the potential of the transmission electrode 506 becomes the largest. An electric field having a large amplitude is therefore emitted from the transmission electrode 506 as a radio wave. On the other hand, in the antenna 550, a high-frequency signal flows in a direction opposite to that of a high-frequency signal in the antenna 520. The operation of the antenna 550 is basically the same as that of the antenna 520, and the description thereof can be understood from the description of the operation of antenna 520. In the above-described communication system, the transmission electrode 506 and the receiving electrode 516 are coupled by electric field coupling and the receiving electrode 516 receives the change in the electric field emitted from the transmission electrode 506, so that the transmission of a high-frequency signal is performed.

The communication system 500 disclosed in Patent Literature 1 has a problem in that it has a low degree of design flexibility. More specifically, as illustrated in FIG. 19, a standing wave is generated at the stub 526. This standing wave is generated as a result of the repeated reflection of a high-frequency signal input from the transmission circuit unit 502 into the stub 526 at both ends of the stub 526.

However, when the input-side end portion of the stub 526 and the node of a standing wave exactly match, the input impedance of the stub 526 becomes 0Ω. Accordingly, the impedance matching between a connector 540 connected to the stub 526 and the stub 526 is broken. As a result, a high-frequency signal cannot enter the stub 526. In order to prevent this situation, in the antenna 520, as illustrated in FIG. 19, the input-side end portion of the stub 526 is slightly shifted from the node of a standing wave. More specifically, the connector 540 is connected to the stub 526 so that the input impedance of the stub 526 and the output impedance of the connector 540 match. That is, as illustrated in FIG. 19, the input-side end portion of the stub 526 is placed at a position apart from the point of connection between the stub 526 and the via-hole conductor 532 by a distance slightly shorter than a half of the wavelength of a high-frequency signal. Consequently, the input impedance of the stub 526 and the output impedance of the connector 540 match, the reflectivity of a high-frequency signal becomes low, and the high-frequency signal is input from the connector 540 to the stub 526.

SUMMARY

The present disclosure provides an antenna than can have a high degree of design flexibility.

In accordance with one representative aspect of the disclosure, an antenna includes a ground conductor to which a ground potential is applied, a linear conductor configured to transmit a high-frequency signal, an insulating layer configured to isolate the ground conductor and the linear conductor from each other, and a radiation conductor that is connected between the linear conductor and the ground conductor. The radiation conductor has a line width larger than that of the linear conductor between a point of connection to the linear conductor and a point of connection to the ground conductor, and is configured to emit an electric field.

DETAILED DESCRIPTION

The inventors realized that in order to meet the above-described design condition for impedance matching, it is necessary to accurately connect the connector 540 to the stub 526. More specifically, the input impedance of the stub 526 whose one end is connected to the ground is low at both ends thereof and high at the center thereof like the standing wave. Furthermore, the rate of change of the input impedance of the stub 526 whose one end is connected to the ground is high at both ends thereof and low at the center thereof like the standing wave. The connector 540 is connected to the end portion of the stub 526. Accordingly, when the point of connection between the connector 540 and the stub 526 is slightly shifted from an original point, the input impedance of the stub 526 is significantly deviated from the output impedance of the connector 540. As a result, the reflectivity of a high-frequency signal cannot be reduced and the high-frequency signal cannot be input from the connector 540 to the stub 526. Because of the above-described reason, it is necessary to accurately connect the connector 540 to the stub 526 in the antenna 520. This leads to low design flexibility. For example, when an RF cable is used as the connector 540 and a characteristic impedance is changed from 50Ω to 35Ω, the point of connection between the connector 540 and the antenna 520 is required to be redesigned. At the time of actual use, the characteristic impedance of a connector or a cable varies from product to product. Therefore, after the antenna 520 has been designed for a specific connector, it is very difficult to change the connector to another connector or a cable. In the antenna 550, a similar problem occurs.

An antenna according to exemplary embodiments that can address the above constraining issues are now described with reference to the accompanying drawings.

Figure 1:
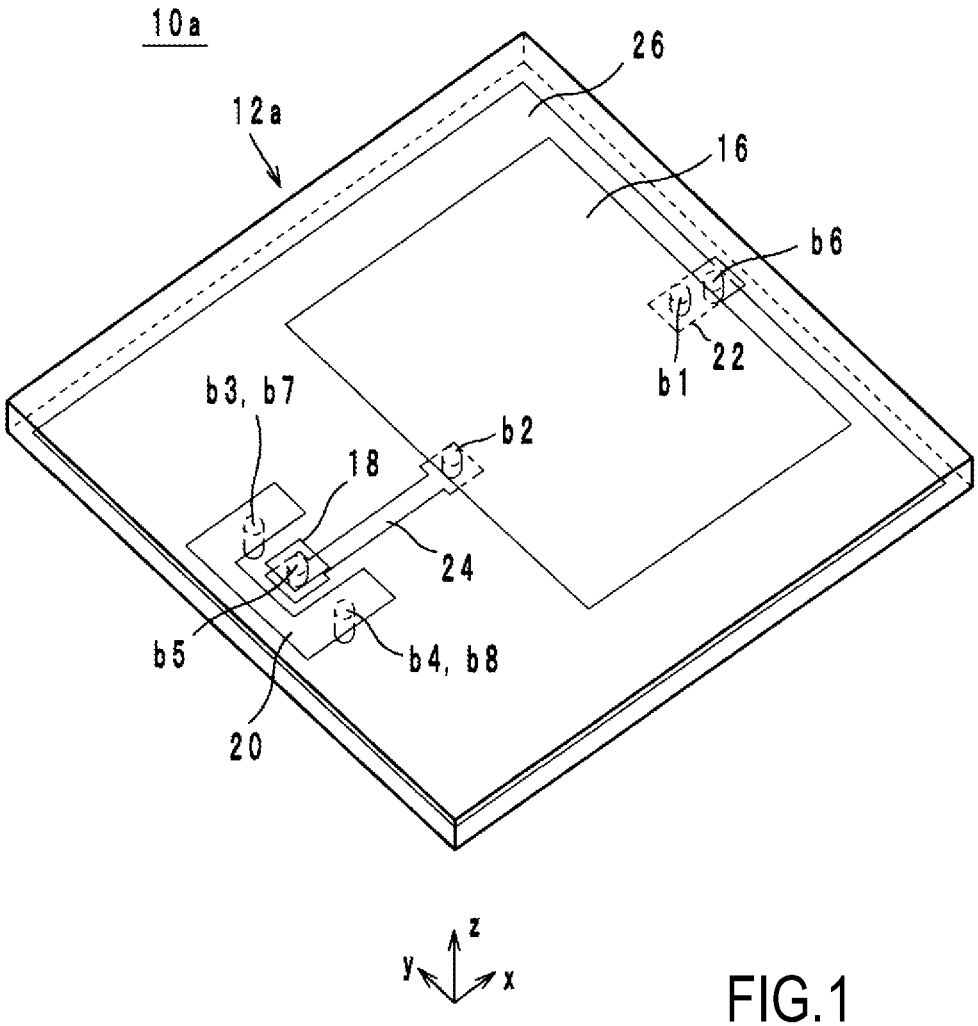
FIG. 1 is a perspective view of an antenna according to a first exemplary embodiment.

The structure of an antenna according to a first exemplary embodiment will now be described with reference to FIGS. 1 to 3. FIG. 1 is a perspective view of an antenna 10*a* according to the first embodiment. FIGS. 2A to 2C are exploded views of the antenna 10*a* illustrated in FIG. 1. FIG. 3 is an equivalent circuit diagram of the antenna 10*a* illustrated in FIG. 1. In FIGS. 1 and 2A-2C, a direction in which insulating layers are laminated or stacked is defined as a z-axis direction, and directions along sides of the antenna 10*a* in plan view from the z-axis direction are defined as an x-axis direction and a y-axis direction. The x-axis direction, the y-axis direction, and the z-axis direction are orthogonal to one another.

Figure 17:
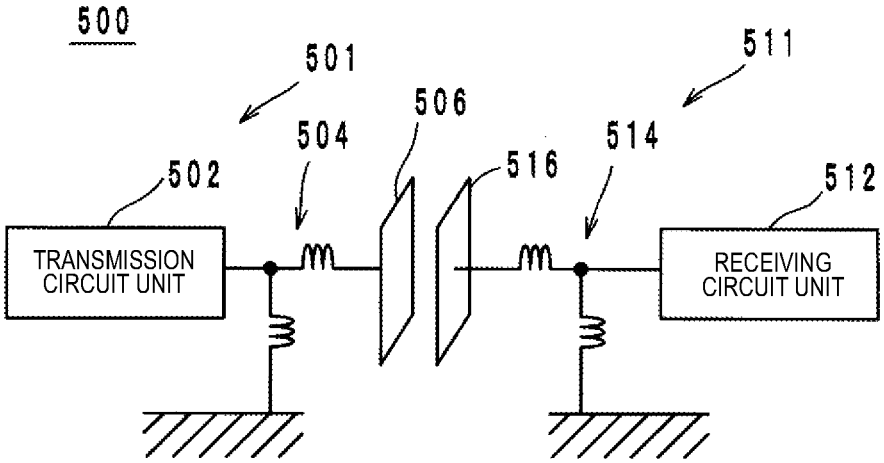
FIG.17 Prior Art
FIG. 17 is a block diagram of a communication system disclosed in Patent Literature 1.

The antenna 10*a* can be used in, for example, a communication system such as communication system 500 illustrated in FIG. 17, and, more specifically, can be used instead of the resonating unit 504 and the transmission electrode 506 or the resonating unit 514 and the receiving electrode 516. A case in which the antenna 10*a* is used as the resonating unit 504 and the transmission electrode 506 will now be described. As illustrated in FIG. 1, the antenna 10*a* includes a body 12*a*, a radiation conductor 16, terminal conductors 18 and 20, a connecting conductor 22, a linear conductor 24, a ground conductor 26, and via-hole conductors b1 to b8.

Figure 2A:
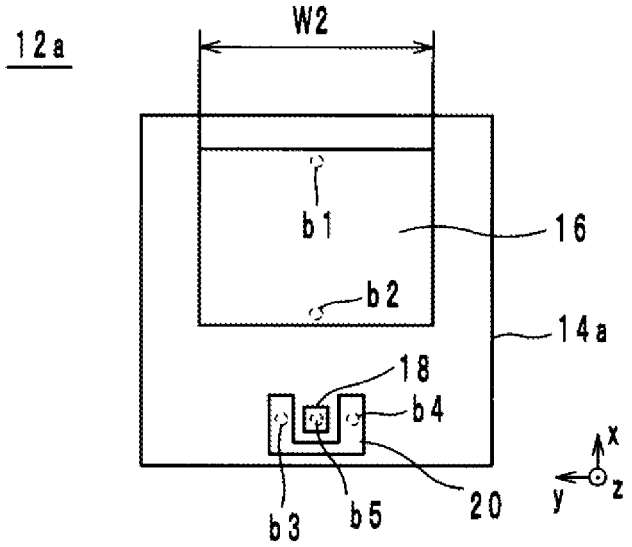
FIG. 2 is an exploded view of the antenna illustrated in FIG. 1.
Figure 2B:
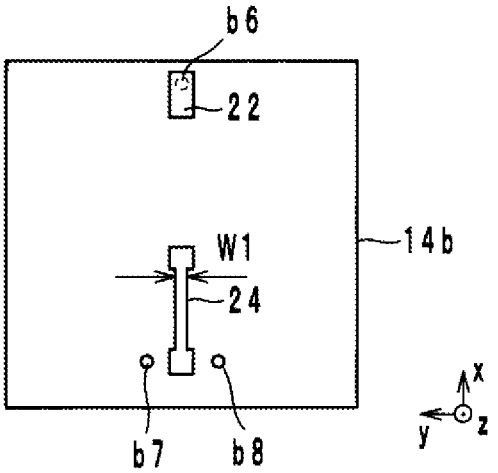
Figure 2C:
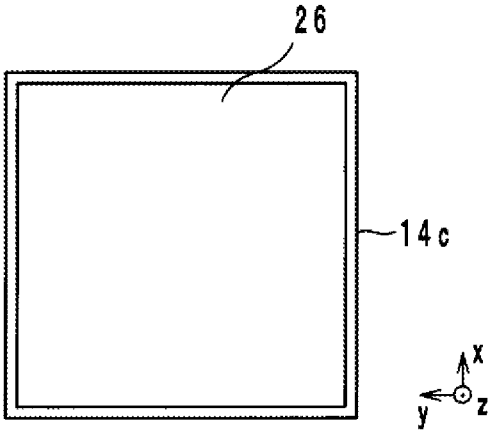
Figure 3:
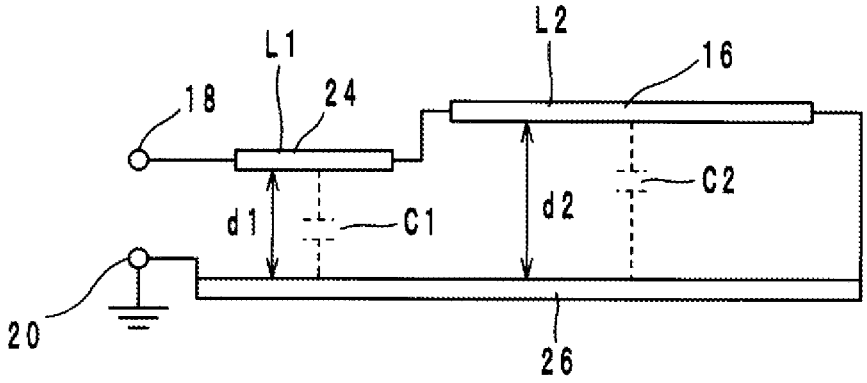
FIG. 3 is an equivalent circuit diagram of the antenna illustrated in FIG. 1.

As illustrated in FIGS. 2A to 2C, the body 12*a* is obtained by laminating a plurality of insulating layers 14 (14*a* to 14*c*) in this order from the positive z-axis direction. The insulating layers 14 are made of a flexible material (for example, a thermoplastic resin such as liquid crystal polymer) and are rectangular in shape. The main surfaces of the insulating layers 14 in the positive z-axis direction are hereinafter referred to as surfaces, and the main surfaces of the insulating layers 14 in the negative z-axis direction are hereinafter referred to as undersurfaces.

As illustrated in FIG. 2A, on the surface of the insulating layer 14*a*, the terminal conductor 18 is disposed, or provided near the side of the insulating layer 14*a* in the negative x-axis direction and is a square. As illustrated in FIG. 1, the terminal conductor 18 is exposed on the main surface of the body 12*a* in the positive z-axis direction. A high-frequency signal (of, for example, 4.48 GHz) generated by the transmission circuit unit 502 illustrated in FIG. 17, for example, is applied to the terminal conductor 18. That is, a signal terminal of a connector (not illustrated) connected to the antenna 10*a* is connected to the terminal conductor 18. As illustrated in FIG. 2A, the via-hole conductor b5 passes through the insulating layer 14*a* in the z-axis direction, and is connected to the terminal conductor 18.

As illustrated in FIG. 2A, on the surface of the insulating layer 14*a*, the terminal conductor 20 is disposed near the side of the insulating layer 14*a* in the negative x-axis direction and surrounds the terminal conductor 18 with three sides thereof. More specifically, the terminal conductor 20 has a rectangular U-shape with an opening in the positive x-axis direction. As illustrated in FIG. 1, the terminal conductor 20 is exposed on the main surface of the body 12*a* in the positive z-axis direction. A ground potential is applied to the terminal conductor 20. That is, the ground terminal of the connector (not illustrated) connected to the antenna 10*a* is connected to the terminal conductor 20. As illustrated in FIG. 2A, the via-hole conductors b3 and b4 pass through the insulating layer 14*a* in the z-axis direction, and are connected to the terminal conductor 20. The via-hole conductors b3 to b5 are arranged in a straight line in the y-axis direction in plan view from the positive z-axis direction.

As illustrated in FIG. 2A, the radiation conductor 16 is disposed on the positive side of the terminal conductors 18 and 20 in the x-axis direction on the surface of the insulating layer 14*a*, and is rectangular in shape. As illustrated in FIG. 2A, the radiation conductor 16 has a line width W2 in the y-axis direction. As illustrated in FIG. 2A, the via-hole conductors b1 and b2 pass through the insulating layer 14*a* in the z-axis direction, and are connected to the radiation conductor 16. The via-hole conductor b1 is connected to a point near the midpoint of a long side of the radiation conductor 16 in the positive x-axis direction. The via-hole conductor b2 is connected to a point near the midpoint of a long side of the radiation conductor 16 in the negative x-axis direction. Accordingly, the via-hole conductors b1 and b2 are arranged in a straight line in the x-axis direction.

As illustrated in FIG. 2B, the linear conductor 24 is disposed on the surface of the insulating layer 14*b*. The linear conductor 24 extends in the x-axis direction, and has a line width W1 smaller than the line width W2. As illustrated in FIG. 1, the end portion of the linear conductor 24 in the negative x-axis direction overlaps the terminal conductor 18 in plan view from the z-axis direction. The terminal conductor 18 is connected to the linear conductor 24 via the via-hole conductor b5. On the other hand, as illustrated in FIG. 1, the end portion of the linear conductor 24 in the positive x-axis direction overlaps the radiation conductor 16 in plan view from the z-axis direction. The terminal conductor 18 is connected to the radiation conductor 16 via the via-hole conductor b2.

As illustrated in FIG. 2B, the connecting conductor 22 is a linear conductor that is disposed on the surface of the insulating layer 14*b* and extends in the x-axis direction. As illustrated in FIG. 1, the end portion of the connecting conductor 22 in the negative x-axis direction overlaps the radiation conductor 16 in plan view from the z-axis direction. The connecting conductor 22 is connected to the radiation conductor 16 via the via-hole conductor b1. On the other hand, the end portion of the connecting conductor 22 in the positive x-axis direction does not overlap the radiation conductor 16 in plan view from the z-axis direction.

The via-hole conductor b6 passes through the insulating layer 14*b* in the z-axis direction, and is connected to the end portion of the connecting conductor 22 in the positive x-axis direction. The via-hole conductors b7 and b8 pass through the insulating layer 14*b* in the z-axis direction, and are connected to the via-hole conductors b3 and b4, respectively.

As illustrated in FIG. 2C, the ground conductor 26 is disposed so that it covers the entire surface, or substantially the entire surface of the insulating layer 14*c*. In order to prevent a short circuit, the ground conductor 26 is not in contact with each side of the insulating layer 14*c* so as not to be exposed on the side surfaces of the body 12*a*. The ground conductor 26 is connected to the connecting conductor 22 via the via-hole conductor b6. The connecting conductor 22 is therefore connected between the ground conductor 26 and the radiation conductor 16. Furthermore, the ground conductor 26 is connected to the terminal conductor 20 via the via-hole conductors b3, b4, b7, and b8. A ground potential is therefore applied to the ground conductor 26.

When the insulating layers 14*a* to 14*c* having the above-described structures are laminated, the linear conductor 24 and the ground conductor 26 are insulated from each other by the insulating layer 14*b*. The linear conductor 24 faces the ground conductor 26 via the insulating layer 14*b* in plan view from the z-axis direction. Accordingly, the linear conductor 24 and the ground conductor 26 provide a microstrip line structure.

The radiation conductor 16 and the ground conductor 26 are insulated from each other by the insulating layers 14*a* and 14*b* so that they are not directly connected to each other. The radiation conductor 16 faces the ground conductor 26 via the insulating layers 14*a* and 14*b* in plan view from the z-axis direction.

The number of the insulating layers 14 between the radiation conductor 16 and the ground conductor 26 (two layers, the insulating layers 14*a* and 14*b*) is larger than that between the linear conductor 24 and the ground conductor 26 (one layer, the insulating layer 14*b*). Accordingly, a distance d2 between the radiation conductor 16 and the ground conductor 26 in the z-axis direction is larger than a distance d1 between the linear conductor 24 and the ground conductor 26 in the z-axis direction.

As illustrated in FIG. 1, when the insulating layers 14*a* to 14*c* are laminated, the radiation conductor 16 is connected between the linear conductor 24 and the ground conductor 26. Between a point of connection to the linear conductor 24 (that is, the via-hole conductor b2) and a point of connection to the ground conductor 26 (that is, the via-hole conductor b1), the radiation conductor 16 has the line width W2 larger than the line width W1 of the linear conductor 24. As illustrated in FIGS. 1 and 2, the radiation conductor 16 has an area larger than that of the linear conductor 24.

An equivalent circuit diagram of the antenna 10*a* having the above-described structure is as illustrated in FIG. 3. More specifically, between the terminal conductors 18 and 20, the linear conductor 24, the radiation conductor 16, and the ground conductor 26 are connected in series in this order. A capacitance C1 is generated between the linear conductor 24 and the ground conductor 26. A capacitance C2 is generated between the radiation conductor 16 and the ground conductor 26. The linear conductor 24 generates an inductance L1. The radiation conductor 16 generates an inductance L2. That is, in the antenna 10*a*, a resonance circuit including the capacitances C1 and C2 and the inductances L1 and L2 is provided.

The antenna 10*a* is designed so that the capacitances C1 and C2 and the inductances L1 and L2 satisfy the following conditions. More specifically, a relationship represented by equation (1) is established among a center frequency f of a high-frequency signal transmitted in the antenna 10*a*, the capacitances C1 and C2, and the inductances L1 and L2.

$$f=2\pi/\sqrt{\{(L1+L2)\times(C1+C2)\}} \quad (1)$$

(C2 is substantially zero)

The input impedance Z of the antenna 10*a* needs to match the output impedance (for example 50Ω) of the transmission circuit unit 502 illustrated in FIG. 17. A relationship represented by equation (2) is established among the capacitances C1 and C2, the inductances L1 and L2, and the input impedance Z.

$$Z=\sqrt{/\{(L1+L2)/(C1+C2)\}} \quad (2)$$

(C2 is substantially zero)

In the antenna 10*a*, the linear conductor 24 and the radiation conductor 16 are designed so that the capacitances C1 and C2 and the inductances L1 and L2 satisfy equations (1) and (2). Here, the linear conductor 24 and the radiation conductor 16 are preferably designed so that a reactance X1 (|L2/C2|) of the radiation conductor 16 is larger than a reactance X2 (|L1/C1|) of the linear conductor 24.

The antenna 10*a* having the above-described structure can be used in, for example, the communication system 500 illustrated in FIG. 17, and, more specifically, can be used instead of the resonating unit 504 and the transmission electrode 506 or the resonating unit 514 and the receiving electrode 516. In this case, two antennas 10*a* are close to each other so that the distance between two radiation conductors 16 is several centimeters. In the antenna 10*a* used instead of the resonating unit 504 and the transmission electrode 506, a high-frequency signal is applied to the terminal conductor 18 and a ground potential is applied to the terminal conductor 20. Subsequently, the high-frequency signal is input into the radiation conductor 16 via the linear conductor 24. The radiation conductor 16 emits an electric field that is changed in accordance with the high-frequency signal in the positive z-axis direction.

On the other hand, in the antenna 10*a* used as the resonating unit 514 and the receiving electrode 516, the radiation conductor 16 absorbs the emitted electric field. Subsequently, the high-frequency signal is externally output from the antenna 10*a* via the linear conductor 24 and the terminal conductor 18.

An exemplary manufacturing method of the antenna 10*a* will now be described below with reference to FIGS. 2A to 2C. An exemplary case in which a single antenna 10*a* is manufactured will be described. In reality, however, a plurality of antennas 10*a* are manufactured at the same time by laminating large insulating layers and cutting the laminate.

First, the insulating layers 14 that are made of liquid crystal polymer and include copper foil on the entire surfaces thereof are prepared. Subsequently, the radiation conductor 16 and the terminal conductors 18 and 20 illustrated in FIG. 2A are formed on the surface of the insulating layer 14*a* by photolithography. More specifically, a resist having the same shape as that of each of the radiation conductor 16 and the terminal conductors 18 and 20 illustrated in FIG. 2A is printed on the copper foil on the insulating layer 14*a*. A part of the copper foil which is not covered with the resist is removed by etching the part of the copper foil. Subsequently, the resist is removed. As a result, the radiation conductor 16 and the terminal conductors 18 and 20 illustrated in FIG. 2 are formed on the surface of the insulating layer 14*a*.

Subsequently, the connecting conductor 22 and the linear conductor 24 illustrated in FIG. 2B are formed on the surface of the insulating layer 14*b* by photolithography. The ground conductor 26 illustrated in FIG. 2C is formed on the surface of the insulating layer 14*c* by photolithography. These photolithography processes are similar to the photolithography process of forming the radiation conductor 16 and the terminal conductors 18 and 20, and the description thereof can be inferred from the above photolithography processes that form those conductors.

Subsequently, a laser beam is emitted from the undersurfaces of the insulating layers 14*a* and 14*b* to positions at which the via-hole conductors b1 to b8 are to be formed, so that via holes are formed. Subsequently, a conductive paste mainly composed of copper is charged into the via holes formed in the insulating layers 14*a* and 14*b*, so that the via-hole conductors b1 to b8 illustrated in FIGS. 2A and 2B are formed.

Subsequently, the insulating layers 14*a* to 14*c* are laminated in this order. The insulating layers 14*a* to 14*c* are press-bonded by applying a force to the insulating layers 14*a* to 14*c* from the positive and negative z-axis directions. Consequently, the antenna 10*a* illustrated in FIG. 1 is obtained.

As will be described later, the antenna 10*a* having the above-described structure has a high degree of design flexibility. More specifically, in the antenna 520 in the communication system 500 disclosed in Patent Literature 1, a standing wave is generated at the stub 526 and an electric field is emitted from the transmission electrode 506 with the standing wave. In order to generate the standing wave, it is necessary to achieve matching between the input impedance of the stub 526 and the output impedance of the connector 540 by accurately connecting the connector 540 to the stub 526. Therefore, the design flexibility of the antenna 520 is low.

On the other hand, the antenna 10*a* uses no standing wave to emit an electric field. The antenna 10*a* includes an LC resonance circuit, and only a high-frequency signal having the center frequency f of the LC resonance circuit is transmitted through the linear conductor 24 and the radiation conductor 16. The line width W2 of the radiation conductor 16 is larger than the line width W1 of the linear conductor 24, and the area of the radiation conductor 16 is larger than that of the linear conductor 24. As a result, the radiation conductor 16 emits an electric field that is changed in accordance with a high-frequency signal. That is, like the antennas 520 and 550, two antennas 10*a* can communicate with each other by near field radio communication.

In the antenna 10*a*, the linear conductor 24, the radiation conductor 16, and the ground conductor 26 are connected in series, and an LC resonance circuit is formed between the terminal conductors 18 and 20. Accordingly, the center frequency f of a high-frequency signal transmitted through the antenna 10*a* is determined by the capacitance C1 and the inductance L1 of the linear conductor 24 and the capacitance C2 and the inductance L2 of the radiation conductor 16 as described previously. The capacitances C1 and C2 and the inductances L1 and L2 can be adjusted by changing the shapes (for example line widths or lengths) of the linear conductor 24 and the radiation conductor 16. That is, in the antenna 10*a*, impedance matching can be achieved by optionally adjusting a plurality of design factors. On the other hand, in the antenna 520, it is necessary to accurately connect the connector 540 to the stub 526 so that the desired length of the stub 526 is obtained. That is, in the antenna 520, only the length of the stub 526 is used to achieve impedance matching. Thus, the antenna 10*a* has a higher degree of design flexibility than the antenna 520. By changing the line width or line length of the linear conductor 24 or the presence or absence of a slit portion in a length direction, it is possible to provide a multistage LC resonance circuit that includes the capacitances C1 and the inductances L1 and has a wide band of emission frequencies.

Figure 18:
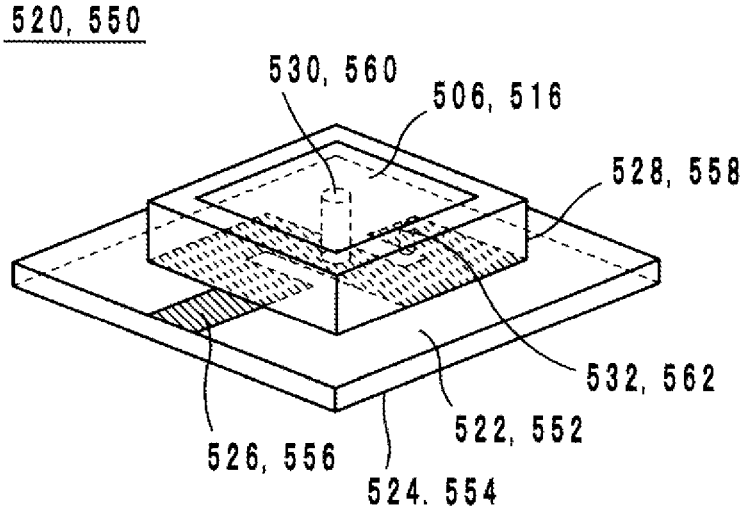
FIG.18 Prior Art
FIG. 18 is a perspective view of antennas used in the communication system illustrated in FIG. 17.
Figure 19:
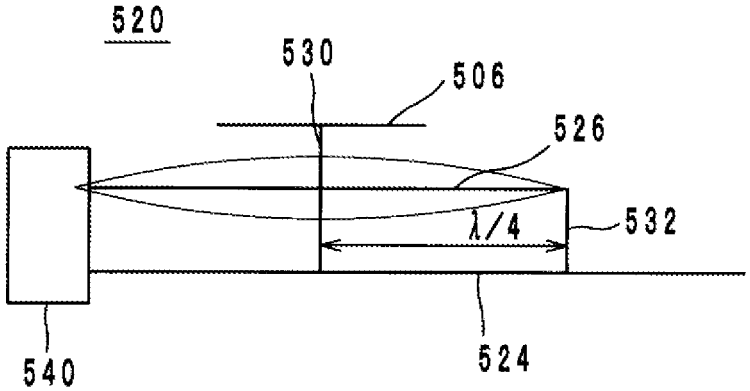
FIG.19 Prior Art
FIG. 19 is an equivalent circuit diagram of the antenna illustrated in FIG. 18.

In the antenna 10*a*, the height in the z-axis direction can be reduced (hereinafter referred to as profile reduction). More specifically, the antenna 520 illustrated in FIG. 18 is a dipole antenna whose both ends are shorted. That is, in the antenna 520, the via-hole conductor 530 extends upward from the stub 526 and the transmission electrode 506 extending in the horizontal direction is disposed at the leading end of the via-hole conductor 530. The antenna 520 is therefore increased in height by the height of the via-hole conductor 530.

On the other hand, in the antenna 10*a*, the radiation conductor 16 included in the LC resonance circuit emits an electric field. Accordingly, dislike the antenna 520, there is no need for the antenna 10*a* to have the structure of a dipole antenna whose both ends are shorted. The profile reduction of the antenna 10*a* can be therefore achieved.

In the antenna 10*a*, as will be described later, the radiation conductor 16 can emit a stronger electric field. More specifically, when the radiation conductor 16 is close to the ground conductor 26, the most part of an electric field emitted from the radiation conductor 16 is directed toward the ground conductor 26 (that is, in the negative z-axis direction) and is consumed by the ground conductor 26. Accordingly, it is difficult for the radiation conductor 16 to emit a strong electric field in the positive z-axis direction.

In the antenna 10*a*, the distance d2 between the radiation conductor 16 and the ground conductor 26 in the z-axis direction is larger than the distance d1 between the linear conductor 24 and the ground conductor 26 in the z-axis direction. The radiation conductor 16 is therefore apart from the ground conductor 26. As a result, a most part of an electric field emitted from the radiation conductor 16 is directed in the positive z-axis direction. That is, in the antenna 10*a*, the radiation conductor 16 can emit a stronger electric field.

The ground conductor 26 and the linear conductor 24 form a microstrip line. Therefore, the characteristic impedance (the input impedance and the output impedance) of the linear conductor 24 can easily match the characteristic impedance of the radiation conductor 16 and a characteristic impedance of another component.

In the antennas 10*a*, even when the distance between two radiation conductors 16 is changed, the transmission characteristic of a high-frequency signal is not deteriorated. More specifically, the antennas 520 and 550 are designed so that, when the distance between the transmission electrode 506 and the receiving electrode 516 becomes a predetermined distance (for example 3 cm), a predetermined capacitance is generated between the transmission electrode 506 and the receiving electrode 516 and the input impedance of the antenna 520 matches the output impedance (for example 50≠) of the transmission circuit unit 502 (that is, impedance matching between them is achieved). Similarly, the antennas 520 and 550 are designed so that, when the distance between the transmission electrode 506 and the receiving electrode 516 becomes a predetermined distance, a predetermined capacitance is generated between the transmission electrode 506 and the receiving electrode 516 and the output impedance of the antenna 550 matches the input impedance of the receiving circuit unit 512 (that is, impedance matching between them is achieved). Accordingly, when the distance between the transmission electrode 506 and the receiving electrode 516 deviates from a predetermined distance, impedance matching is not achieved. In this case, in the antennas 520 and 550, the transmission of a high-frequency signal cannot be performed.

On the other hand, in the antenna 10*a*, impedance matching with the transmission circuit unit 502 or the receiving circuit unit 512 is achieved with an LC resonance circuit including the linear conductor 24, the ground conductor 26, and the radiation conductor 16. As described previously, the capacitance C2 between the ground conductor 26 and the radiation conductor 16 is substantially zero. Therefore, the impedance of the LC resonance circuit does not depend on the capacitance C2. That is, the impedance is practically determined in accordance with the inductance L1 of the linear conductor 24, the inductance L2 of the radiation conductor 16, and the capacitance C1 between the linear conductor 24 and the ground conductor 26. Even when the distance between the radiation conductors 16 is changed, impedance matching between the antenna 10*a* and the transmission circuit unit 502 or the receiving circuit unit 512 can be achieved. Accordingly, in the antennas 10*a*, even when the distance between the radiation conductors 16 is changed, the transmission characteristic of a high-frequency signal is not deteriorated.

Figure 4:
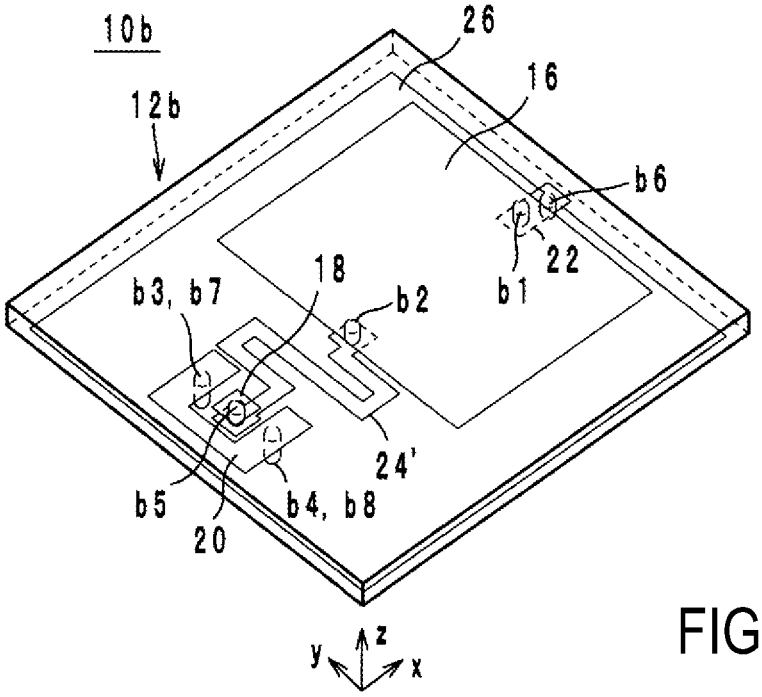
FIG. 4 is a perspective view of an antenna that is a first exemplary modification.

Exemplary modifications of the antenna 10*a* will now be described below with reference to the accompanying drawings. FIG. 4 is a perspective view of an antenna 10*b* that is a first exemplary modification. The antenna 10*b* is the same as the antenna 10*a* except that the antenna 10*b* includes a meandering linear conductor 24', and thus description of other points of the antenna 10*b* is provided above.

By making the linear conductor 24' meander, the inductance L1 of the linear conductor 24' can be increased. That is, in the antenna 10*b*, the range of adjustment of the inductance L1 can be increased. As a result, the adjustment of the resonant frequency of the antenna 10*b* and the impedance matching between the antenna 10*b* and the transmission circuit unit 502 or the receiving circuit unit 512 can be easily performed.

Figure 5:
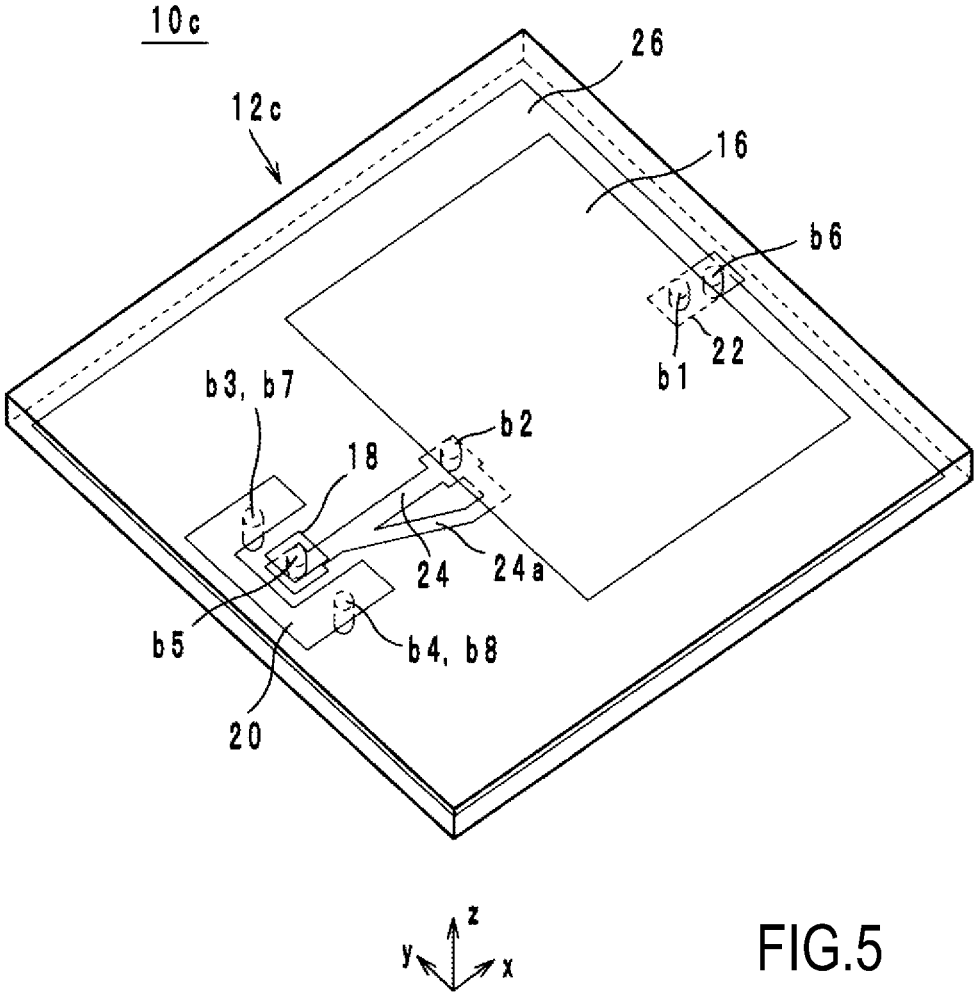
FIG. 5 is a perspective view of an antenna that is a second exemplary modification.

FIG. 5 is a perspective view of an antenna 10*c* that is a second exemplary modification of the antenna 10*a*. The antenna 10*c* is the same as the antenna 10*a* except that the antenna 10*c* includes a linear conductor 24*a* in addition to the linear conductor 24, and thus description of other points of the antenna 10*c* is provided above.

The linear conductor 24*a* is connected in parallel to the linear conductor 24. Thus, in the antenna 10*c*, a plurality of linear conductors connected in parallel, the linear conductors 24 and 24*a*, may be disposed. As a result, multiple resonances can be obtained and a frequency band can be increased to, for example, 4.48 GHz±200 MHz. The line widths of the linear conductors 24 and 24*a* may be the same or different. By opening one of the ends of the linear conductors 24 and 24*a*, an open stub-type linear conductor may be formed.

Figure 6:
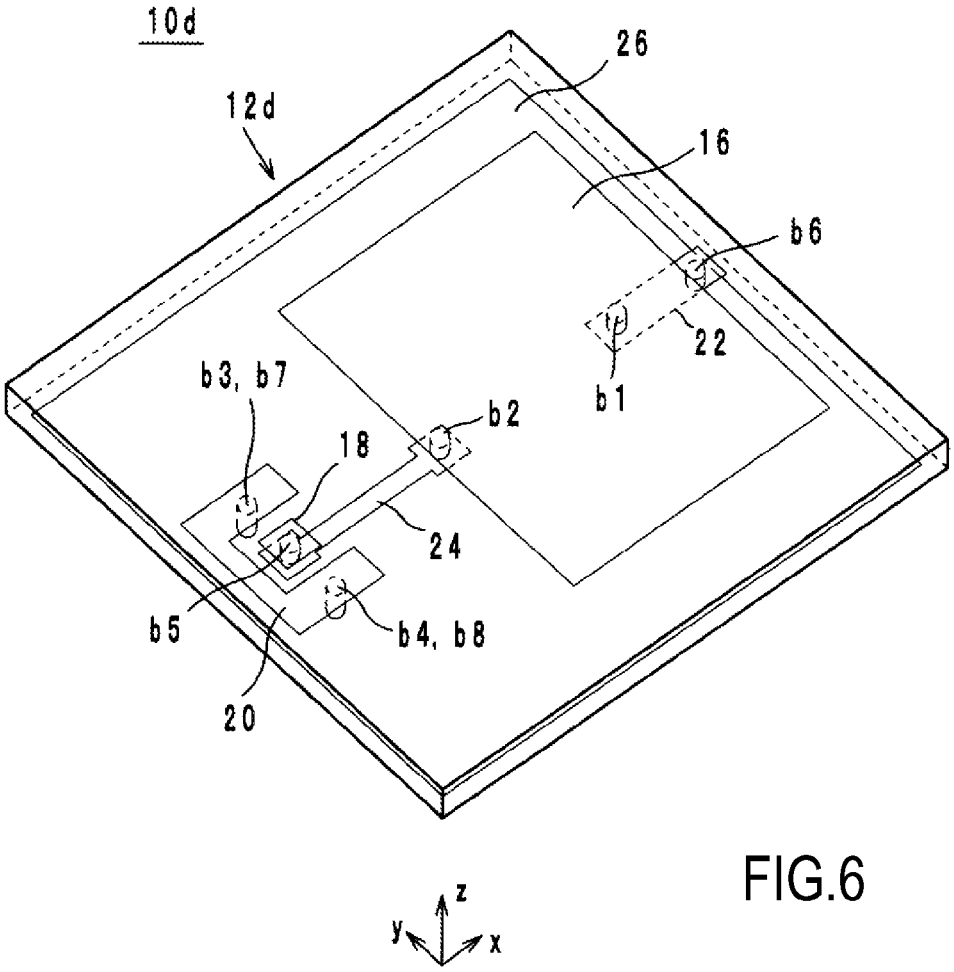
FIG. 6 is a perspective view of an antenna that is a third exemplary modification.
Figure 7:
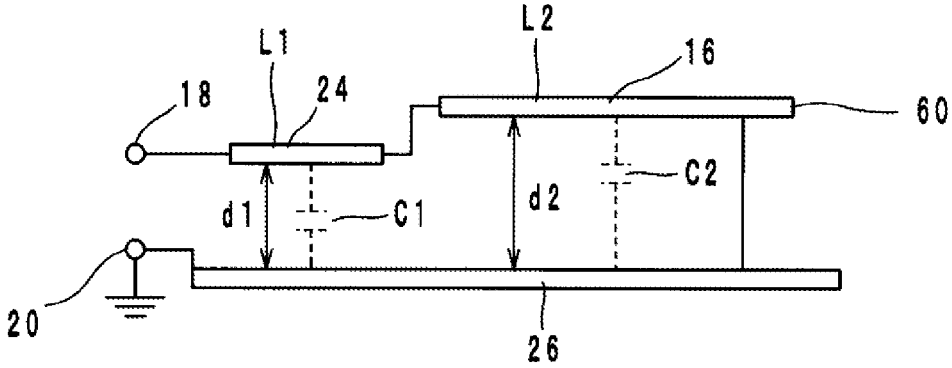
FIG. 7 is an equivalent circuit diagram of the antenna illustrated in FIG. 6.

FIG. 6 is a perspective view of an antenna 10*d* that is a third exemplary modification of the antenna 10*a*. FIG. 7 is an equivalent circuit diagram of the antenna 10*d* illustrated in FIG. 6. The antenna 10*d* is the same as the antenna 10*a* except that, in the antenna 10*d*, the position of the via-hole conductor b1 is nearer to the center of the radiation conductor 16 than that in the antenna 10*a*, and thus description of other points of the antenna 10*d* is provided above.

In the antenna 10*d*, the point of connection between the radiation conductor 16 and the ground conductor 26 via the via-hole conductor b1 is nearer to the center of the radiation conductor 16 than that in the antenna 10*a*. Accordingly, in the antenna 10*d*, the position of the via-hole conductor b1 is farther from the side of the radiation conductor 16 in the positive x-axis direction than that in the antenna 10*a*. As a result, as illustrated in FIG. 7, an end portion 60 is formed at the radiation conductor 16. The end portion 60 of the radiation conductor 16 functions as an open stub, and a gain can be improved.

Figure 8:
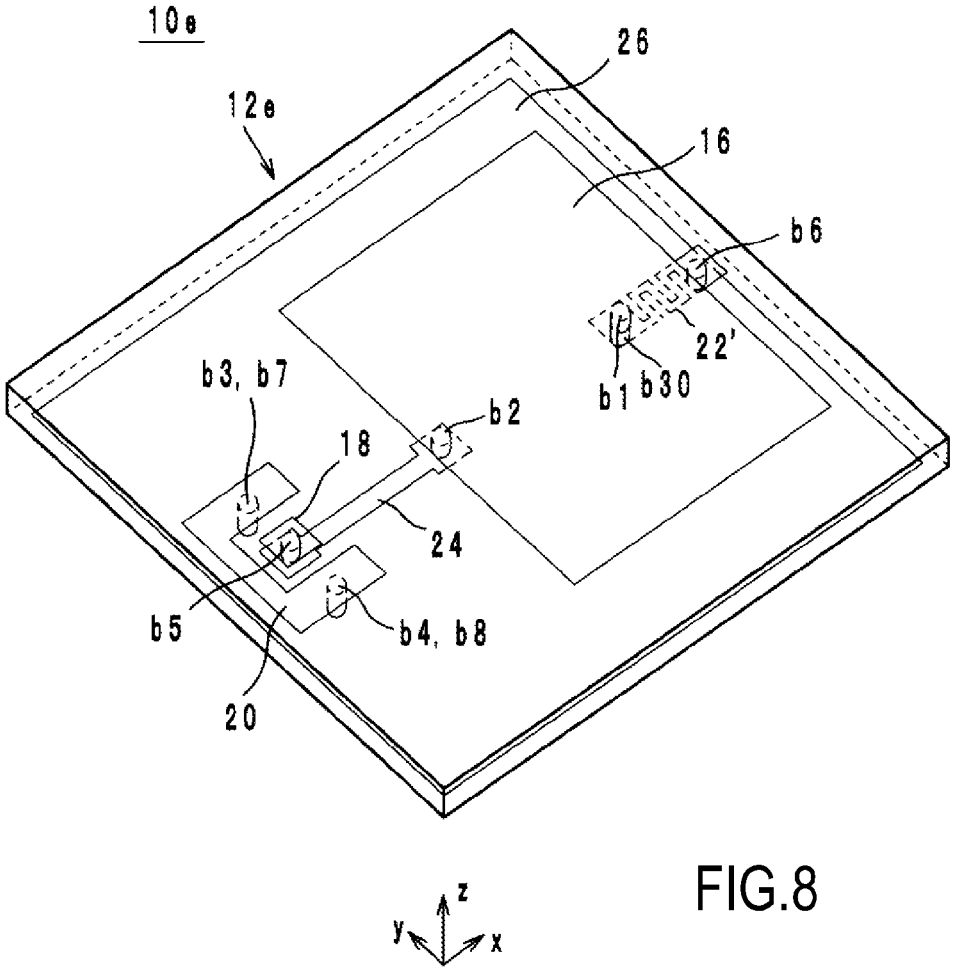
FIG. 8 is a perspective view of an antenna that is a fourth exemplary modification.
Figure 9:
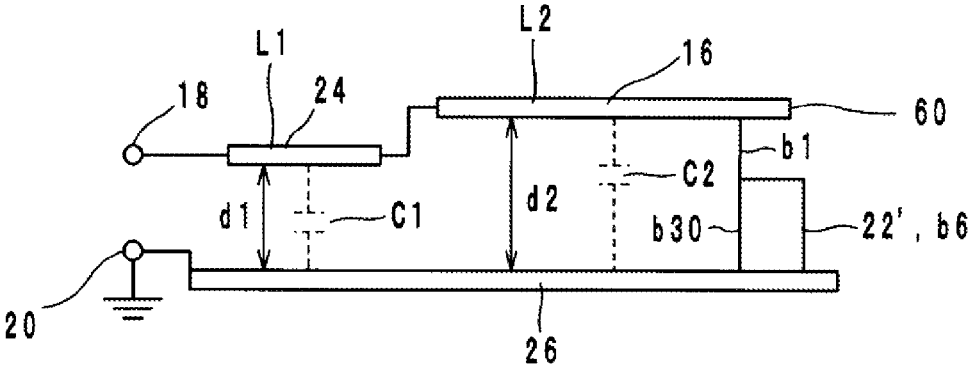
FIG. 9 is an equivalent circuit diagram of the antenna illustrated in FIG. 8.

FIG. 8 is a perspective view of an antenna 10*e* that is a fourth exemplary modification of the antenna 10*a*. FIG. 9 is an equivalent circuit diagram of the antenna 10*e* illustrated in FIG. 8. The antenna 10*e* is the same as the antenna 10*a* except that, in the antenna 10*e*, a connecting conductor 22' is meandering and the end portion of the connecting conductor 22' is connected to the ground conductor 26 via a via-hole conductor b30, and thus description of other points of the antenna 10*e* is provided above.

In the antenna 10*e*, since the connecting conductor 22' is meandering, it functions as an inductive line. Since the via-hole conductor b30 is disposed, the radiation conductor 16 and the ground conductor 26 are connected with a line having two branches as illustrated in FIG. 9. As a result, gain control can be performed. In other embodiments, the via-hole conductor b30 may not be provided.

Figure 10:
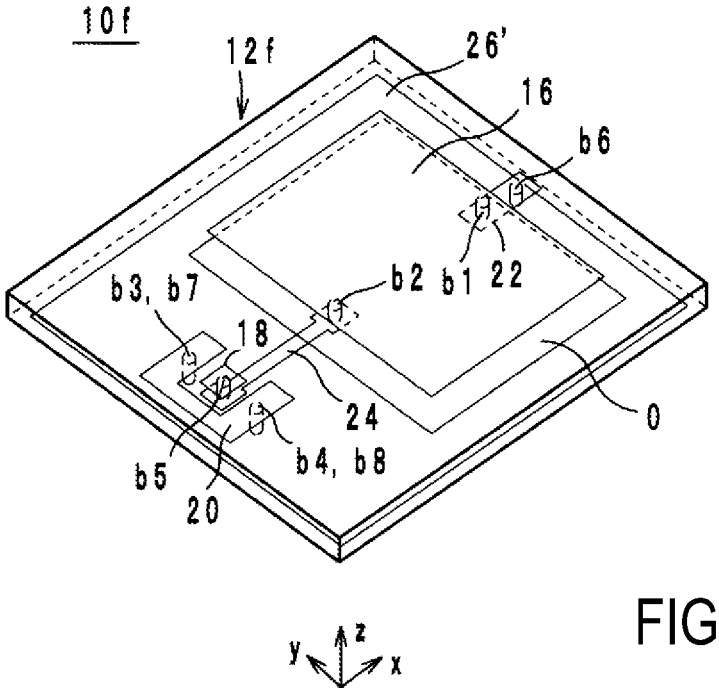
FIG. 10 is a perspective view of an antenna that is a fifth exemplary modification.

FIG. 10 is a perspective view of an antenna 10*f* that is a fifth exemplary modification of the antenna 10*a*. The antenna 10*f* is the same as the antenna 10*a* except that the antenna 10*f* includes a ground conductor 26' having an opening O, and thus description of other points of the antenna 10*f* is provided above.

The ground conductor 26' has the opening O in which no conductor is disposed at a position overlapping the radiation conductor 16 in plan view from the z-axis direction. Therefore, the radiation conductor 16 does not overlap the ground conductor 26' in plan view from the z-axis direction (a normal direction with respect to the radiation conductor 16 or a stacking direction of the insulating layers 14*a* to 14*c*). As a result, little electric field is consumed by the ground conductor 26'. The antenna 10*f* can therefore emit a stronger electric field from the radiation conductor 16 as compared with the antenna 10*a*.

In the antenna 10*f*, since the radiation conductor 16 and the ground conductor 26' do not face each other, the capacitance C2 generated therebetween is substantially zero. Thus, a capacitance in the antenna 10*f* is reduced. That is, the input impedance of the antenna 10*f* as viewed from an input port is practically seen as an inductance, and the output impedance of the input port as viewed from the antenna 10*f* is seen as 50Ω. By achieving impedance matching at this portion, the reflection characteristic of the input impedance becomes deeper and the favorable reflection characteristic is obtained over a wide frequency band. Thus, when the capacitance in the antenna 10*f* is reduced, the usable frequency band of the antenna 10*f* can be increased.

Figure 11:
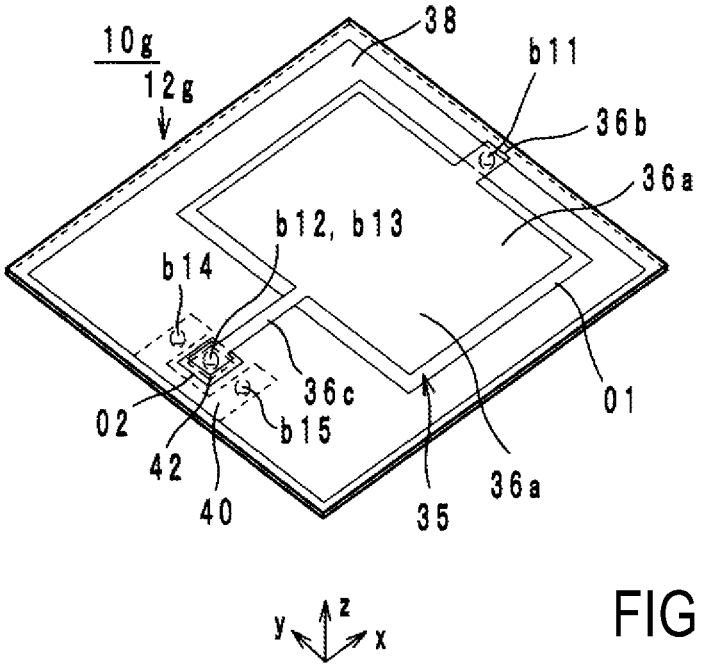
FIG. 11 is a perspective view of an antenna according to a second exemplary embodiment.
Figure 12A:
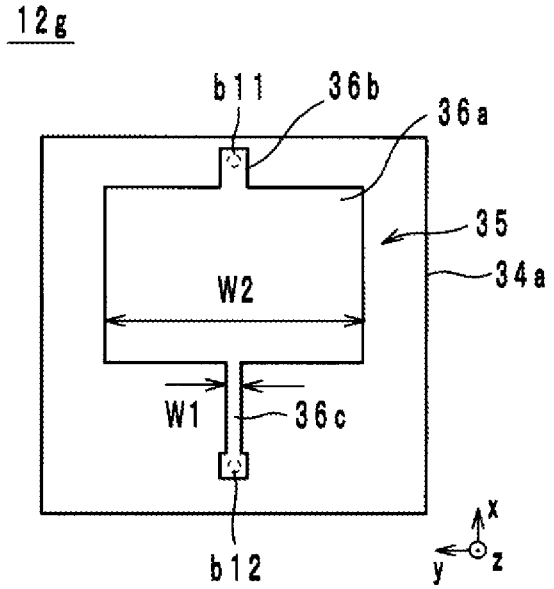
FIG. 12 is an exploded view of the antenna illustrated in FIG. 11.
Figure 12B:
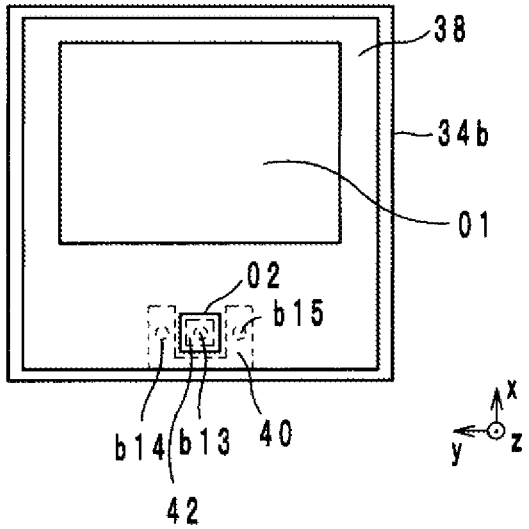

Structure of an antenna according to a second exemplary embodiment will now be described with reference to FIGS. 11 to 12B of the accompanying drawings. FIG. 11 is a perspective view of an antenna 10*g* according to the second exemplary embodiment. FIGS. 12A and 12B are exploded views of the antenna 10*g* illustrated in FIG. 11. In FIGS. 11, 12A and 12B, the direction in which insulating layers are laminated or stacked is defined as the z-axis direction, and directions along sides of the antenna 10*g* in plan view from the z-axis direction are defined as the x-axis direction and the y-axis direction. The x-axis direction, the y-axis direction, and the z-axis direction are orthogonal to one another.

As illustrated in FIG. 11, the antenna 10*g* includes a body 12*g*, a conductor 35, a ground conductor 38, terminal conductors 40 and 42, and via-hole conductors b11 to b15.

As illustrated in FIGS. 12A and 12B, the body 12*g* is obtained by laminating a plurality of insulating layers 34 (34*a* and 34*b*) in this order from the positive z-axis direction. The insulating layers 34 are made of a flexible material (for example, a thermoplastic resin such as liquid crystal polymer) and are rectangular in shape. The main surfaces of the insulating layers 34 in the positive z-axis direction are hereinafter referred to as surfaces, and the main surfaces of the insulating layers 34 in the negative z-axis direction are hereinafter referred to as undersurfaces.

As illustrated in FIG. 12B, the ground conductor 38 is disposed on the surface of the insulating layer 34*b*. At the ground conductor 38, openings O1 and O2 in which no conductor is disposed are formed.

As illustrated in FIG. 12B, on the undersurface of the insulating layer 34*b*, the terminal conductor 42 is disposed near the side of the insulating layer 34*b* in the negative x-axis direction and is a square. As illustrated in FIG. 11, the terminal conductor 42 is exposed on the main surface of the body 12*g* in the negative z-axis direction. Furthermore, the terminal conductor 42 is disposed so that it is inside the opening O2 in plan view from the z-axis direction. A high-frequency signal generated by a transmission circuit, for example, transmission circuit unit 502 illustrated in FIG. 17, is applied to the terminal conductor 42.

As illustrated in FIG. 12B, the via-hole conductor b13 passes through the insulating layer 34*b* in the z-axis direction in the opening O2, and is connected to the terminal conductor 42. The via-hole conductor b13 is insulated from the ground conductor 38.

As illustrated in FIG. 12B, on the undersurface of the insulating layer 34*b*, the terminal conductor 40 is disposed near the side of the insulating layer 34*b* in the negative x-axis direction and surrounds the terminal conductor 42 with three sides thereof. More specifically, the terminal conductor 40 has a rectangular U-shape with an opening in the positive x-axis direction. As illustrated in FIG. 11, the terminal conductor 40 is exposed on the main surface of the body 12*g* in the negative z-axis direction. A ground potential is applied to the terminal conductor 40. As illustrated in FIG. 12B, the via-hole conductors b14 and b15 pass through the insulating layer 34*b* in the z-axis direction, and are connected to the terminal conductor 40 and the ground conductor 38. The via-hole conductors b13 to b15 are arranged in a straight line in the y-axis direction in plan view from the positive z-axis direction.

The conductor 35 includes a radiation conductor 36*a*, a connecting conductor 36*b*, and a linear conductor 36*c*. As illustrated in FIG. 12A, the radiation conductor 36*a* is disposed on the surface of the insulating layer 34*a* and is rectangular in shape. As illustrated in FIG. 11, the radiation conductor 36*a* is disposed so that it is inside the opening O1 in plan view from the z-axis direction. That is, the radiation conductor 36*a* and the ground conductor 38 do not face each other. As illustrated in FIG. 12A, the radiation conductor 36*a* has the line width W2 in the y-axis direction.

As illustrated in FIG. 12A, the connecting conductor 36*b* is disposed on the surface of the insulating layer 34*a*, and is a linear conductor extending from the midpoint of the long side of the radiation conductor 36*a* in the positive x-axis direction toward the positive x-axis direction. The via-hole conductor b11 passes through the insulating layer 34*a* in the z-axis direction, and connects the connecting conductor 36*b* and the ground conductor 38.

As illustrated in FIG. 12A, the linear conductor 36*c* is disposed on the surface of the insulating layer 34*a*, and extends from the midpoint of the long side of the radiation conductor 36*a* in the negative x-axis direction toward the negative x-axis direction. The linear conductor 36*c* has the line width W1 smaller than the line width W2. As illustrated in FIG. 11, the end portion of the linear conductor 36*c* in the negative x-axis direction overlaps the terminal conductor 42 in plan view from the z-axis direction. The via-hole conductor b12 passes through the insulating layer 34*a* in the z-axis direction, and is connected to the linear conductor 36*c* and the via-hole conductor b13. The linear conductor 36*c* and the terminal conductor 42 are therefore connected to each other via the via-hole conductors b12 and b13.

The antenna 10*g* having the above-described structure can obtain an operational effect similar to that of the antenna 10*a*.

Furthermore, the profile reduction of the antenna 10*g* can be achieved. More specifically, since the radiation conductor 36*a* and the ground conductor 38 do not face each other, little electric field emitted from the radiation conductor 36*a* is consumed by the ground conductor 38 even when the distance between the radiation conductor 36*a* and the ground conductor 38 in the z-axis direction is reduced. Accordingly, in the antenna 10*g*, only a single layer, the insulating layer 34*a*, is needed between the radiation conductor 36*a* and the ground conductor 38. As a result, the profile reduction of the antenna 10*g* can be achieved.

Figure 13:
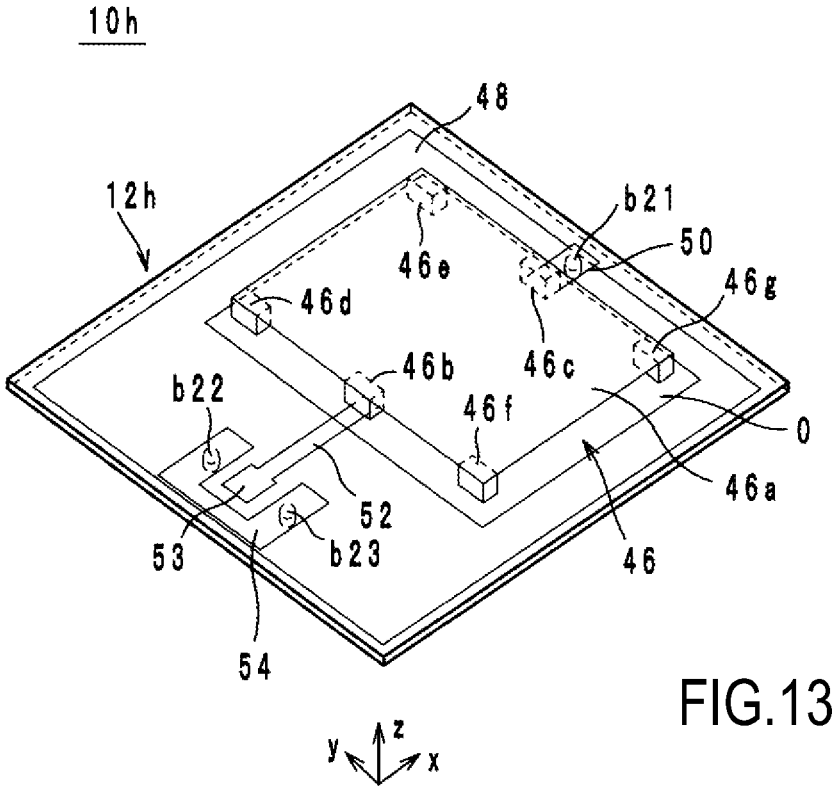
FIG. 13 is a perspective view of an antenna according to a third exemplary embodiment.
Figure 14A:
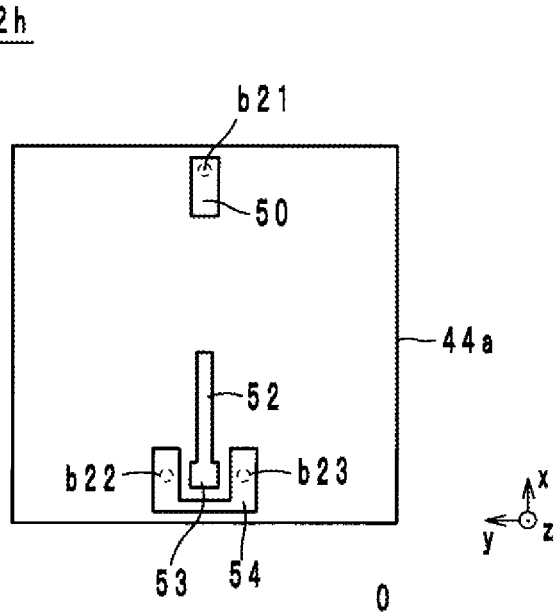
FIG. 14 is an exploded view of the antenna illustrated in FIG. 13.
Figure 14B:
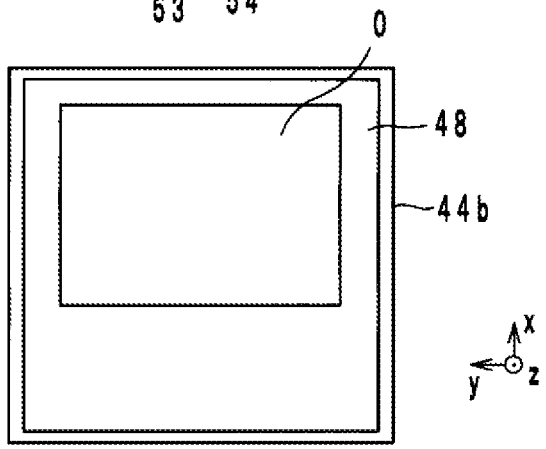

The structure of an antenna according to a third exemplary embodiment will now be described below with reference to FIGS. 13, 14A and 14B of the accompanying drawings. FIG. 13 is a perspective view of an antenna 10*h* according to the third exemplary embodiment. FIGS. 14A and 14B are exploded views of the antenna 10*h* illustrated in FIG. 13. In FIGS. 13, 14A and 14B, the direction in which insulating layers are laminated or stacked is defined as the z-axis direction, and directions along sides of the antenna 10*h* in plan view from the z-axis direction are defined as the x-axis direction and the y-axis direction. The x-axis direction, the y-axis direction, and the z-axis direction are orthogonal to one another.

As illustrated in FIG. 13, the antenna 10*h* includes a body 12*h*, a radiation conductor 46, a ground conductor 48, a connecting conductor 50, a linear conductor 52, terminal conductors 53 and 54, and via-hole conductors b21 to b23.

As illustrated in FIGS. 14A and 14B, the body 12*h* is obtained by laminating a plurality of insulating layers 44 (44*a* and 44*b*) in this order from the positive z-axis direction. The insulating layers 44 are made of a flexible material (for example, a thermoplastic resin such as liquid crystal polymer) and are rectangular in shape. The main surfaces of the insulating layers 44 in the positive z-axis direction are hereinafter referred to as surfaces, and the main surfaces of the insulating layers 44 in the negative z-axis direction are hereinafter referred to as undersurfaces.

As illustrated in FIG. 14A, on the surface of the insulating layer 44*a*, the terminal conductor 53 is disposed near the side of the insulating layer 44*a* in the negative x-axis direction, and is a square. As illustrated in FIG. 13, the terminal conductor 53 is exposed on the main surface of the body 12*h* in the positive z-axis direction. A high-frequency signal generated by a transmission circuit, for example, the transmission circuit unit 502 illustrated in FIG. 17, is applied to the terminal conductor 53.

As illustrated in FIG. 14A, on the surface of the insulating layer 44*a*, the terminal conductor 54 is disposed near the side of the insulating layer 44*a* in the negative x-axis direction and surrounds the terminal conductor 53 with three sides thereof. More specifically, the terminal conductor 54 has a rectangular U-shape with an opening in the positive x-axis direction. As illustrated in FIG. 13, the terminal conductor 54 is exposed on the main surface of the body 12*h* in the positive z-axis direction. A ground potential is applied to the terminal conductor 54. As illustrated in FIG. 14A, the via-hole conductors b22 and b23 pass through the insulating layer 44*a* in the z-axis direction, and are connected to the terminal conductor 54.

As illustrated in FIG. 14B, the ground conductor 48 is disposed on the surface of the insulating layer 44*b*. At the ground conductor 48, the opening O in which no conductor is disposed is formed. The ground conductor 48 overlaps the terminal conductor 54 in plan view from the z-axis direction. The ground conductor 48 and the terminal conductor 54 are connected to each other via the via-hole conductors b22 and b23.

As illustrated in FIG. 14A, the linear conductor 52 is disposed on the surface of the insulating layer 44*a*, and extends from the terminal conductor 53 toward the positive x-axis direction. As illustrated in FIG. 13, the end portion of the linear conductor 52 in the positive x-axis direction is inside the opening O in plan view from the z-axis direction.

As illustrated in FIG. 14A, the connecting conductor 50 is disposed on the surface of the insulating layer 44*a*, and is a linear conductor extending in the x-axis direction. As illustrated in FIG. 13, the end portion of the connecting conductor 50 in the negative x-axis direction overlaps the opening O in plan view from the z-axis direction. On the other hand, the end portion of the connecting conductor 50 in the positive x-axis direction overlaps the ground conductor 48 in plan view from the z-axis direction. The via-hole conductor b21 passes through the insulating layer 44*a* in the z-axis direction, and connects the connecting conductor 50 and the ground conductor 48.

As illustrated in FIG. 13, for example, the radiation conductor 46 is created by bending a single metal plate. More specifically, the radiation conductor 46 includes a radiation portion 46*a* and leg portions 46*b* to 46*g*. The radiation portion 46*a* is a rectangular metal plate, and emits an electric field.

The leg portion 46*b* is formed by bending in the negative z-axis direction a protrusion extending from the midpoint of the long side of the radiation portion 46*a* in the negative x-axis direction toward the negative x-axis direction. The leg portion 46*c* is formed by bending in the negative z-axis direction a protrusion extending from the midpoint of the long side of the radiation portion 46*a* in the positive x-axis direction toward the positive x-axis direction. The leg portion 46*d* is formed by bending in the negative z-axis direction a protrusion extending from the corner of the radiation portion 46*a* in the negative x-axis direction and the positive y-axis direction toward the negative x-axis direction. The leg portion 46*e* is formed by bending in the negative z-axis direction a protrusion extending from the corner of the radiation portion 46*a* in the positive x-axis direction and the positive y-axis direction toward the positive x-axis direction. The leg portion 46*f* is formed by bending in the negative z-axis direction a protrusion extending from the corner of the radiation portion 46*a* in the negative x-axis direction and the negative y-axis direction toward the negative x-axis direction. The leg portion 46*g* is formed by bending in the negative z-axis direction a protrusion extending from the corner of the radiation portion 46*a* in the positive x-axis direction and the negative y-axis direction toward the positive x-axis direction.

As illustrated in FIG. 13, the radiation conductor 46 is attached to the body 12*h* so that the leg portion 46*b* is connected to the end portion of the linear conductor 52 in the positive x-axis direction and the leg portion 46*c* is connected to the end portion of the connecting conductor 50 in the negative x-axis direction. At that time, the radiation portion 46*a* is inside the opening O in plan view from the z-axis direction. That is, the radiation portion 46*a* does not face the ground conductor 48.

The antenna 10*h* having the above-described structure can obtain an operational effect similar to that of the antenna 10*a*.

In the antenna 10*h*, the radiation conductor 46 is formed of not copper foil, but a metal plate. Accordingly, in the antenna 10*h*, by adjusting the lengths of the leg portions 46*b* to 46*g*, the capacitance C2 and the inductance L2 of the radiation conductor 46 can be adjusted.

Figure 15:
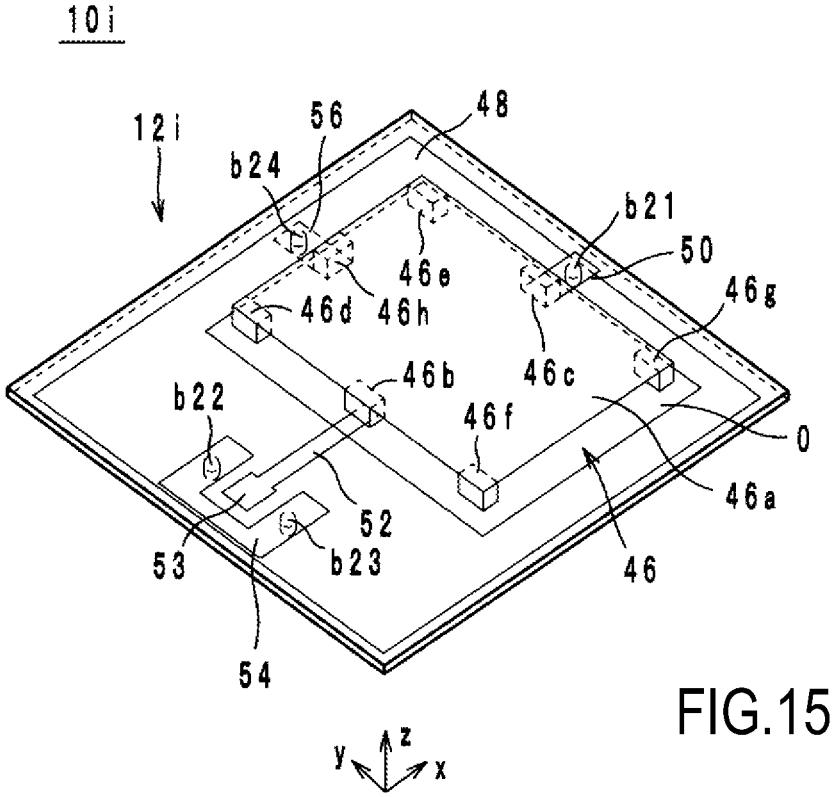
FIG. 15 is a perspective view of an antenna that is a first exemplary modification.

An antenna that is an exemplary modification of the antenna 10*h* will be described below with reference to FIG. 15 of the accompanying drawings. FIG. 15 is a perspective view of an antenna 10*i* that is the first modification. The antenna 10*i* is the same as the antenna 10*h* except that the antenna 10*i* further includes a leg portion 46*h*, a connecting conductor 56, and a via-hole conductor b24, and thus description of other points of the antenna 10*h* are described above.

The connecting conductor 56 is disposed on the surface of the insulating layer 44*a*, and is a linear conductor extending in the y-axis direction. As illustrated in FIG. 15, the end portion of the connecting conductor 56 in the negative y-axis direction overlaps the opening O in plan view from the z-axis direction. On the other hand, the end portion of the connecting conductor 56 in the positive y-axis direction overlaps the ground conductor 48 in plan view from the z-axis direction. The via-hole conductor b24 passes through the insulating layer 44*a* in the z-axis direction, and connects the connecting conductor 56 and the ground conductor 48.

The radiation conductor 46 further includes the leg portion 46*h*. The leg portion 46*h* is formed by bending in the negative z-axis direction a protrusion extending from the midpoint of the short side of the radiation portion 46*a* in the positive y-axis direction toward the positive y-axis direction. The leg portion 46*h* is connected to the connecting conductor 56.

Thus, in the antenna 10*i*, there are two points of connection between the ground conductor 48 and the radiation conductor 46. Accordingly, the capacitance C2 and the inductance L2 of the radiation conductor 46 can be adjusted.

Figure 16:
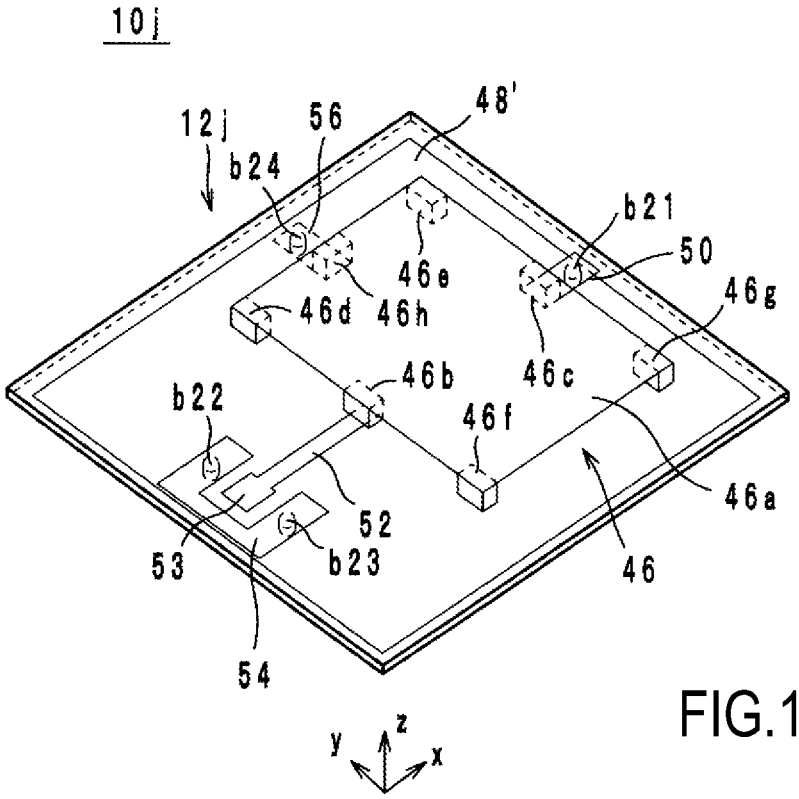
FIG. 16 is a perspective view of an antenna that is a second exemplary modification.

FIG. 16 is a perspective view of an antenna 10*j* that is the second exemplary modification of the antenna 10*h*. The antenna 10*j* is the same as the antenna 10*i* except that a ground conductor 48' has no opening O, and thus description of other points of antenna 10*j* are described above.

Embodiments consistent with the present disclosure are useful for an antenna, and, in particular, has an advantage in its suitability for providing a high degree of design flexibility.

That which is claimed is:

1. An antenna comprising:

a ground conductor to which a ground potential is applied;

a linear conductor configured to transmit a high-frequency signal;

an insulating layer configured to isolate the ground conductor and the linear conductor from each other; and a radiation conductor that is connected between the linear conductor and the ground conductor, wherein the radiation conductor has a first edge and a second edge opposite to the first edge, the radiation conductor is connected to the linear conductor by a first point of connection closer to the first edge than to the second edge, the radiation conductor is connected to the ground connector by a second point of connection closer to the second edge than the first edge, the radiation conductor has a line width larger than a line width of the linear conductor when measured in the same direction, the first edge and the second edge are outside peripheral edges of the radiation conductor, and the center frequency of a high-frequency signal transmitted through the antenna is determined by a capacitance C1 between the linear conductor and the ground conductor, an inductance L1 of the linear conductor, a capacitance C2 between the radiation conductor and the ground conductor, and an inductance L2 of the radiation conductor.

2. The antenna according to claim 1, wherein the linear conductor and the radiation conductor face the ground conductor via the insulating layer, and wherein a distance between the radiation conductor and the ground conductor is larger than that between the linear conductor and the ground conductor.

3. The antenna according to claim 2, wherein a number of the insulating layers between the ground conductor and the radiation conductor is larger than that between the ground conductor and the linear conductor.

4. The antenna according to claim 1, wherein the ground conductor is disposed so that the ground conductor does not overlap the radiation conductor in plan view from a normal direction with respect to a main surface of the radiation conductor.

5. The antenna according to claim 1, wherein a reactance of the radiation conductor is larger than that of the linear conductor.

6. The antenna according to claim 2, wherein a reactance of the radiation conductor is larger than that of the linear conductor.

7. The antenna according to claim 3, wherein a reactance of the radiation conductor is larger than that of the linear conductor.

8. The antenna according to claim 4, wherein a reactance of the radiation conductor is larger than that of the linear conductor.

9. The antenna according to claim 1, further comprising:

a first terminal connected to the linear conductor; and a second terminal connected to the ground conductor.

10. The antenna according to claim 1, wherein the ground conductor and the linear conductor form a microstrip line structure.

11. The antenna according to claim 2, wherein the ground conductor and the linear conductor form a microstrip line structure.

12. The antenna according to claim 3, wherein the ground conductor and the linear conductor form a microstrip line structure.

13. The antenna according to claim 4, wherein the ground conductor and the linear conductor form a microstrip line structure.

14. The antenna according to claim 5, wherein the ground conductor and the linear conductor form a microstrip line structure.

15. The antenna according to claim 1, wherein an area of the radiation conductor is larger than that of the linear conductor.

16. The antenna according to claim 2, wherein an area of the radiation conductor is larger than that of the linear conductor.

17. The antenna according to claim 4, wherein an area of the radiation conductor is larger than that of the linear conductor.

18. The antenna according to claim 1, wherein a plurality of the linear conductors are connected in parallel.

19. The antenna according to claim 2, wherein a plurality of the linear conductors are connected in parallel.

20. The antenna according to claim 4, wherein a plurality of the linear conductors are connected in parallel.

* * * * *